US006053386A

United States Patent [19]

Reynolds

[11] Patent Number: 6,053,386

[45] Date of Patent: Apr. 25, 2000

[54] TENNIS BALL CONTAINER AND DISPENSER

[76] Inventor: Winston C Reynolds, 16575 NW 20th St., Pembroke Pines, Fla. 33028

[21] Appl. No.: 09/025,132

[22] Filed: Feb. 17, 1998

[51] Int. Cl.[7] ..... A45F 3/10

[52] U.S. Cl. ..... 224/629; 224/645; 224/654; 224/235; 224/242; 224/251; 224/919; 221/45; 221/185

[58] Field of Search ..... 224/919, 629, 224/628, 235, 242, 654, 251, 645; 206/315.9; 221/185, 309, 310, 282, 303, 306, 307, 33, 45, 61; 294/19.2; D3/257, 217, 216

[56] References Cited

U.S. PATENT DOCUMENTS

| | | | |
|---|---|---|---|
| 4,088,251 | 5/1978 | Rodriguez | 224/919 |
| 4,712,712 | 12/1987 | Garden | 221/68 |
| 4,798,319 | 1/1989 | James, Jr. . | |
| 5,064,107 | 11/1991 | Ascarrunz . | |
| 5,086,948 | 2/1992 | Slusarz | 221/185 |
| 5,190,196 | 3/1993 | Hamer, III . | |
| 5,611,457 | 3/1997 | Ash, Jr. . | |
| 5,826,746 | 10/1998 | Ash, Jr. | 221/185 |

*Primary Examiner*—Linda J. Sholl
*Attorney, Agent, or Firm*—Liniak, Berenato, Longacre & White

[57] ABSTRACT

The present invention comprises a serpentine tube which is wide enough to store a tennis ball and allow a tennis ball to roll or otherwise translate within the tube. The serpentine tube has an opening for receiving tennis balls and a dispenser for facilitating selective sequential removal a tennis ball. Gravity causes the tennis balls to roll to the bottom of the tube to a dispenser. The container may be worn by the user by conventional over the shoulder and around the waist straps. The container may be flipped to accommodate both right handed and left handed players. The container may also be pressurized to above atmospheric pressure to increase the life of the tennis balls contained therein.

5 Claims, 2 Drawing Sheets

TENNIS BALL CONTAINER AND DISPENSER

BACKGROUND OF THE INVENTION

1. Field of the Invention

The present invention relates to ball a container and more particularly to a tennis ball container which may be secured to a tennis player and facilitates selective dispensing of tennis balls.

2. Description of the Prior Art

Ball holders, and particularly tennis ball holders are well known in the art. U.S. Pat. No. 4,798,319 to James, Jr. discloses a ball caddy comprising a short longitudinal tube which can accommodate three tennis balls. The tube contains a spring to biase the tennis balls towards the opening. The tube may be attached to a tennis player by belts 14.

U.S. Pat. No. 5,064,107 to Ascarrunz discloses a tennis ball holder comprising a semi-cylindrical elongated tubular member which retains the tennis ball by compression. The holder may accommodate up to three tennis balls. The holder may be secured to a player by a belt.

U.S. Pat. No. 4,088,251 to Rodriguez discloses a tennis ball holder comprising an elongated longitudinal tube. An inclined elbow joint is disposed at one end of the tube to retain the balls when in a vertical position. This holder limits the amount of tennis balls which may be retained and is awkward and cumbersome when attached to a player.

It is an object of the present invention to provide a tennis ball container which can contain an increased number of tennis balls while facilitate easy dispensing of each ball in a comfortable an unencumbered manner when worn by a tennis player.

SUMMARY OF THE INVENTION

The present invention comprises a serpentine tube which is wide enough to store a tennis ball and allow a tennis ball to roll, or otherwise translate, within the tube. The serpentine tube has an opening for receiving tennis balls and a dispenser for facilitating selective sequential removal a tennis ball. When worn by a tennis player, tennis balls may simply be placed in the opening located just behind the players shoulder. Gravity causes the tennis balls to roll to the bottom of the tube to the dispenser. The container may be worn by the user by conventional over the shoulder and around the waist straps. The container may be flipped to accommodate both right handed and left handed players.

DETAILED DESCRIPTION OF THE PREFERRED EMBODIMENT

Figure 1:
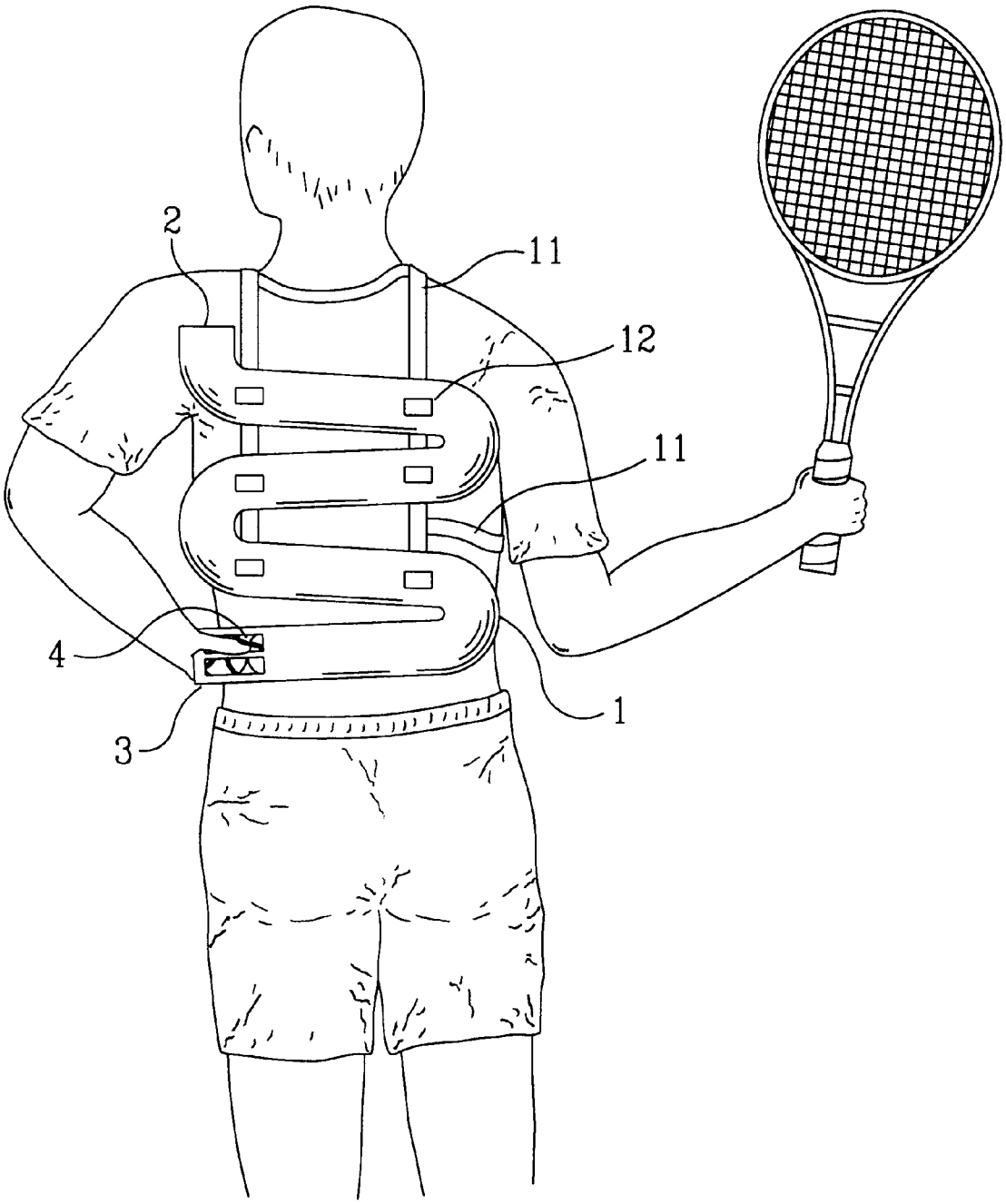
FIG. 1 depicts the ball container of the present invention as worn by a tennis player.

FIG. 1 represents the tennis ball container according to the invention. A serpentine tubular member 1 has an opening 2 and a dispenser end 3. The tubular member 1 has an internal diameter larger than a size tennis ball to allow a tennis ball to roll or freely translate along the length of the container. Horizontal portions of the tubular member are slightly oblique with respect to the ground when worn by a player in the upright position. Such an arrangement facilitates the downward movement of tennis balls from the opening 2 to the dispenser end 3 through gravitational force.

The serpentine configuration provides at least two distinct advantages over the tennis ball containers of the prior art. Firstly, the single file arrangement of the tennis balls promotes the continuous feed of tennis balls to the dispenser end without the risk of balls getting clogged or jammed over other gravitational feed ball containers. Secondly, the serpentine arrangement dramatically increased the number of tennis balls which may be carried without re-loading.

Additionally, the serpentine arrangement allows tennis balls to be dispensed on either the right hand or left hand side of the player. Right hand players will often prefer to reach for a new tennis ball with their left hand, while grasping their racquet with their right hand. Such an arrangement is depicted in FIG. 1, with the dispenser end positioned along the player's left hand side. However, where a left handed tennis player wishes to reach for a tennis ball with their right hand, the container can be simply rotated 180 degrees.

The container of the instant invention may be secured to a player by straps (or belts) 11. Channels 12 are formed on the container to facilitate attachment of the straps 12. These channels 12 are formed on either side of the container to facilitate the rotation of the container for either right hand or left hand dispensing. It is to be understood, that any conventional means of attaching the straps to the container, or the container to the player, may be substituted for the particular disclosure of the preferred embodiment.

The container may be loaded when either worn by a player or placed on the ground. When worn by a player, the player need only reach just behind their shoulder and drop a tennis ball into the opening 2. The opening 2 is sufficiently large to accommodate easy entrance of tennis balls. Once a ball is dropped in the opening 2, it will roll along the length of the serpentine tubular member until it either confronts the dispenser end or a previously inserted tennis ball. In the preferred embodiment, the serpentine container has three turns so as to accommodate at least twenty one official size tennis balls at one time, while having a width no wider than the width of an average tennis player.

Figure 3:
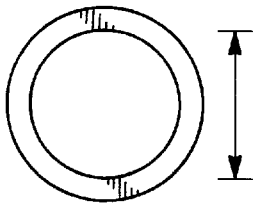
FIG. 3 is a side view of the dispenser end depicted in FIG. 2.
Figure 4:
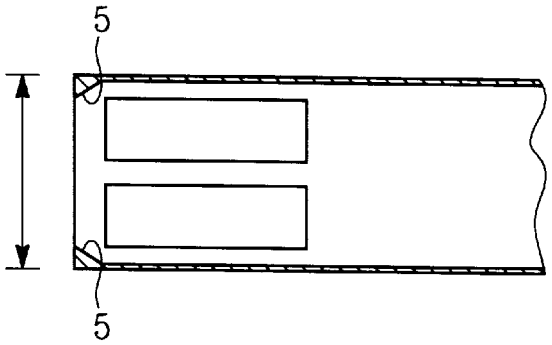
FIG. 4 is a sectional view of the dispenser end of FIG. 2 revealing the restrictor.

The dispenser end of the container includes a restrictor 5 to prevent a tennis ball from passing therethrough. FIG. 4 represents a cross sectional view of the dispenser end of the container with a restrictor 5. FIG. 3 simply represents an end side view of the dispenser revealing the reduced diameter of the restrictor. As previously mentioned the internal diameter of the container is sufficiently large to allow the official size tennis ball to roll or easily translate through the container. However, the restrictor 5 has an internal diameter slightly less than the official size tennis ball. In the preferred embodiment, the thickness of the dispenser end is progressively increased toward the opening of the dispenser end 3, as shown on FIG. 4, so as form the restrictor 5. The restrictor prevents the tennis ball from passing unless an additional force is applied to the tennis ball.

Figure 2:
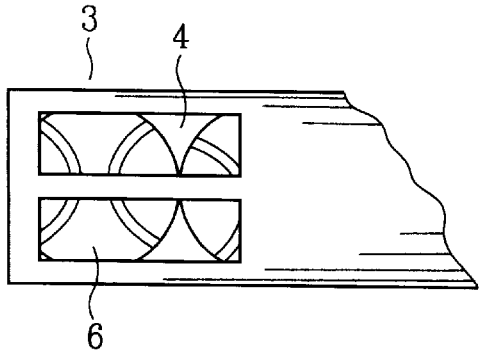
FIG. 2 is an enlarged view of the dispenser end of the container depicted in FIG. 1.

When a tennis player desires a new ball, she simply reaches behind and grasps the dispenser end. As shown in FIG. 2, the dispenser end has an opening 4, preferably at least two openings on either side, to allow a player's finger (or fingers) to reach behind the first tennis ball and push it through the restrictor and thereby removing the ball from the container. That is, as the user pushes each tennis ball, the tennis ball deforms and squeezes through the restictor 5 to emerge from the dispenser end of the container. The remaining tennis balls will then advance making available another tennis ball to be retrieved. This arrangement allows a tennis ball to be retrieved with one hand.

Figure 5:
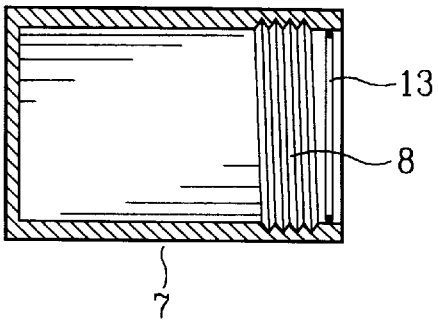
FIG. 5 is a cross sectional view of a cap according to an alternative embodiment of the claimed invention.
Figure 6:
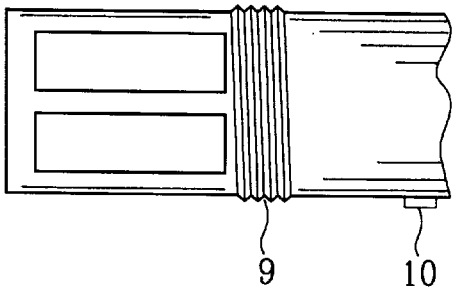
FIG. 6. is a side view of the dispenser end of the container according to an alternative embodiment of the claimed invention.

It is to be understood, that the instant invention is not limited to the specific restrictor arrangement described by the aforementioned preferred embodiment. Other types of restrictors, such as a resilient annular member, a spring biased peg, or other restriction devices may be substituted FIGS. 5 and 6 represent an alternative form of the instant invention. In this invention the container is made air tight. The serpentine tubular container is made of a continuous tubular member. Preferably this member is formed of a rigid plastic material. An end cap 7 is placed on the ends of the container. A resilient annular gasket 13 may be used to provide an airtight seal. The cap 7 may be simply screwed onto the end of the tubular member by means or threads 8 and 9. FIGS. 5 and 6 depict the end cap assembly associated with the dispenser end of the serpentine tubular member. The end cap 7 is of sufficient length to cover the opening 4. An additional end cap may be similarly installed over the opening end 2.

A valve 10 is provided to facilitate entrance of air into the container 1 by means of a conventional pump. This valve may be either a conventional valve to accept a needle or other type of valve. The valve merely facilitates the attachment to the high pressure side of an gas pump to allow introduction of air into the container. Such an arrangement produces above atmospheric pressure in the container thus preserving the life of the tennis balls stored therein.

While the foregoing invention has been shown and described with reference to a specific preferred embodiment, it will be understood by those possessing skill in the art that various changes and modifications may be made without departing from the spirit and scope of the invention.

I claim:

1. A portable device for containing a number of tennis balls and selectively and sequentially dispensing said tennis balls, said device comprising:

a unitary serpentine hollow tubular member disposed substantially vertically between an opening end and a dispenser end, said opening end having an internal diameter sufficiently large to accommodate easy entrance of said tennis balls, said tubular member having an internal diameter larger than an external diameter of said tennis balls contained therein and adapted to feed said tennis balls to said dispenser end by gravitational force, wherein said dispenser end further comprises;

a restrictor adapted to restrict said balls from passing therethrough, said restrictor adapted to allow passage of said balls by application of a second force; and at least one opening adapted to allow said user to apply said second force to urge one of said tennis balls to pass through said restrictor and dispense from said device; said device adapted to be worn by a user, wherein said restrictor is defined by a progressive increase in thickness of said dispenser end so as to progressively reduce said internal diameter to less than said diameter of said tennis balls, whereby said tennis balls are deformed upon application of said second force to squeeze through said restrictor ard emerge from said dispenser.

2. The device according to claim 1, wherein said serpentine tubular member comprises at least three turns to facilitate the storage of at least twenty tennis balls, said device having a width less than a width of an average tennis player.

3. The device according to claim 1, whereby, when said device is worn by said user, said dispenser end may be selectively positioned in one of a left side or a right side of said user by rotating said device 180 ° about a vertical axis.

4. The device according to claim 1, said device comprising an attachment means for securing said device to said user.

5. A device for containing a number of tennis balls, and selectively and sequentially dispensing said tennis balls, said device comprising a serpentine hollow tubular member disposed between an opening end and a dispensing end, said tubular member being adapted to be substantially vertically worn by a user, said tubular member having an internal diameter larger than an external diameter of said balls contained therein and adapted to feed said tennis balls to said dispenser end by gravitational force, wherein said dispenser end further comprises;

a restrictor adapted to restrict said balls from passing therethrough, said restrictor adapted to allow passage of said balls by application of a second force; and an opening adapted to allow a user to apply said second force to urge one of said balls to pass through said restrictor and dispense from said device; wherein said device further comprises a first end cap disposed about said dispensing end and a second end cap disposed about said opening, wherein said serpentine hollow tubular member and said end caps form an air tight container, said container including a valve to facilitate introduction of air to thereby maintain an interior of said container at a pressure above atmospheric pressure.

* * * * *